United States Patent [19]

Moraski et al.

[11] Patent Number: 4,645,904

[45] Date of Patent: Feb. 24, 1987

[54] LIQUEFIED GAS VAPORIZER UNIT

[75] Inventors: Dennis P. Moraski; Bryon L. Sadler, both of King County, Wash.

[73] Assignee: Sam Dick Industries, Inc., Seattle, Wash.

[21] Appl. No.: 735,824

[22] Filed: May 17, 1985

[51] Int. Cl.[4] ..... F17C 7/02; F24H 1/16

[52] U.S. Cl. ..... 219/275; 219/302; 219/308; 219/328

[58] Field of Search ..... 219/271, 272, 275, 302, 219/308, 328; 431/208

[56] References Cited

U.S. PATENT DOCUMENTS

| | | | |
|---|---|---|---|
| 2,166,922 | 7/1939 | White | 219/272 X |
| 2,348,546 | 5/1944 | Kercher | 219/272 X |
| 3,477,644 | 11/1969 | Bablouzian et al. | 431/208 |
| 4,255,646 | 3/1981 | Dragoy et al. | 219/275 |

FOREIGN PATENT DOCUMENTS 530680 3/1955 Italy .

*Primary Examiner*—L. T. Hix
*Assistant Examiner*—Douglas S. Lee
*Attorney, Agent, or Firm*—Seed and Berry

[57] ABSTRACT

A compact liquefied vaporizer for controlled vaporization of liquefied gas. The vaporizer includes a vertically oriented, cylindrical, hollow pressure vessel having a liquefied gas inlet near an open lower end and a gas vapor outlet near closed upper end, and an elongated, one-piece, heat-conductive aluminimum core mounted within the pressure vessel and occupying a substantial portion of the interior volume of the pressure vessel. The core is threaded to provide a closure for the lower end of the pressure vessel and has multiple electrical resistance elements extending longitudinally therein and cast in-situ within the core to provide intimate contact to the core with the exterior of the heating elements. The vaporizer has a thermocouple position within a central bore in the core, and electronic controls connected to the electric resistance heating elements and the thermocouple for regulating the supply of power to the heating elements.

30 Claims, 8 Drawing Figures

LIQUEFIED GAS VAPORIZER UNIT

TECHNICAL FIELD

This invention relates to a vaporizer for efficiently and economically vaporizing liquefied gasses.

BACKGROUND ART

U.S. Pat. No. 4,255,646 discloses an electric-powered vaporizing unit for vaporizing liquefied petroleum gas, the unit having the capability of vaporizing from about 10 to 40 gallons per hour. The design of the unit is such that it cannot be used effectively for vaporizing larger volumes of liquefied gas.

DISCLOSURE OF THE INVENTION

The present invention resides in a compact liquefied gas vaporizer for controlled vaporization of liquefied gas. The vaporizer includes a vertically oriented, cylindrical, hollow pressure vessel having a liquefied gas inlet near an open lower end and a gas vapor outlet near a closed upper end remote from the liquefied gas inlet, and an elongated, one-piece, heat-conductive core mounted within the pressure vessel and occupying a substantial portion of the interior volume of the pressure vessel. The core is positioned to close the lower end of the pressure vessel and has multiple electrical resistance heating elements extending longitudinally therein. The heating elements are cast in-situ within the core to provide intimate contact to the core with the exterior of the heating elements. While in the presently preferred embodiment the pressure vessel is oriented vertically, the gas vaporizer may also be oriented horizontally, such as when multiple cores are mounted within the vessel.

The vaporizer also includes at least one temperature-sensing passageway in the core holding a temperature-sensing means, and control means connected to the heating elements and the temperature-sensing means for regulating the supply of power to the heating elements. The temperature-sensing passageway is a central bore in the core extending longitudinally between the heating elements for at least a portion of the length of the core and not communicating with the interior volume of the pressure vessel. The temperature-sensing means is a thermocouple positioned within the central bore.

The lower end of the pressure vessel is threaded to receive a correspondingly threaded base portion of the core for easy assembly and disassembly of the core and the pressure vessel. The base portion also includes a support flange. The base portion has a downwardly projecting, outwardly opening protective housing attached to a lower end wall of the core and formed as an integral part thereof. The heating elements extend through the lower end wall for connection to electrical power connectors, and the protective housing is sized to receive the power connectors therein. The upper end of the core terminates below the gas vapor outlet to provide a head space above the core for expansion of the rising gas vapor within the pressure vessel in response to heating of the liquefied gas by the heating elements.

The temperature-sensing means is a quick response temperature sensor and the control means includes a time proportional controller for applying electrical power to the heating element with a periodic on/off duty cycle determined by the deviation of the core temperature, as measured by the temperature sensor, from a predetermined set temperature. The duty cycle has a frequency sufficiently to rapidly respond to temperature increases in the core temperature and avoid significant variations in the core temperature from the predetermined value which could cause overheating of the liquefied gas vapor. The increasing of the core temperature above the set temperature proportionately reduces the on time of the duty cycle, and the decreasing of the core temperature below the set temperature proportionately increases the off time of the duty cycle. As such, the controller provides a quick response to temperature variations in the core temperature to avoid temperature overshooting and thus avoid undesirable over-heating of the liquefied gas and gas vapor. The control means further includes a liquefied gas flow inhibit means for inhibiting the flow of liquefied gas into the liquefied gas inlet on start-up until the core temperature reaches a predetermined minimum operating temperature. As such, cold liquefied gas is preventing from reaching the core until the heating elements have had sufficient time to raise the core temperature to the minimum operating temperature. The control means also has a high temperature inhibit means for inhibiting the application of electrical power to the heating elements if the core temperature reaches a predetermined maximum operating temperature. This prevents overheating of the liquefied gas and gas vapor, and damage to the heating elements and pressure vessel.

The vaporizer has a liquefied gas sensing means communicating with the interior of the pressure vessel near its upper end, below the gas vapor outlet, for sensing the level of liquefied gas in the pressure vessel, and controlling a valve regulating the flow of liquefied gas into the liquefied gas inlet. The valve is controlled to shut off the flow of liquefied gas to the pressure vessel before the liquefied gas enters the gas vapor outlet in response to the gas sensing means sensing liquefied gas.

In the presently preferred embodiment of the invention, the core is cast of aluminum, and has a finned exterior surface to provide greater surface area for heat transfer to the liquefied gas. A pressure relief valve is provided communicating with the interior of the pressure vessel near the upper end and is responsive to the pressure of the gas vapor therein.

The vaporizer may be used in a gas vaporizing system in which it operates in a standby mode with a liquefied gas storage tank. The storage tank has a liquefied gas withdrawal line and a gas vapor withdrawal line. The liquefied gas inlet of the pressure vessel is connected to the liquefied gas withdrawal line of the storage tank, and the gas vapor outlet is connected to a gas vapor demand line. The gas vapor demand line is also coupled to the gas vapor withdrawal line of the storage tank. A pressure switch is connected in the liquefied gas withdrawal line and activates the control means of the vaporizer for operating the electric resistance elements therein upon the storage tank pressure falling below a predetermined lower level. The pressure deactivates the control means for inhibiting operation of the heating elements upon the storage tank pressure rising above a predetermined upper level. The upper level pressure is selected at a tank pressure achievable by natural vaporization and sufficient to provide gas vapor directly from the storage tank to the demand line.

A first pressure regulator is positioned in the gas vapor withdrawal line of the storage tank, and a second pressure regulator is positioned in the gas vapor demand line, between the vaporizer pressure vessel and the juncture with the gas vapor withdrawal line of the storage tank. The second pressure regulator has a regulated pressure above the regulated pressure of the first pressure regulator. As such, the second pressure regulator dominates the demand line and insures that when the vaporizer is on, all the flow will be through the vaporizer and none from the vapor withdrawal line of the storage tank. When the vaporizer is off, the first pressure regulator, positioned in the gas vapor withdrawal line of the storage tank, will automatically take over and supply vapor to the demand line.

Other features and advantages of the invention will become apparent from the following more detailed description, taken in conjunction with the accompanying drawings.

BEST MODE FOR CARRYING OUT THE INVENTION

Figure 1:
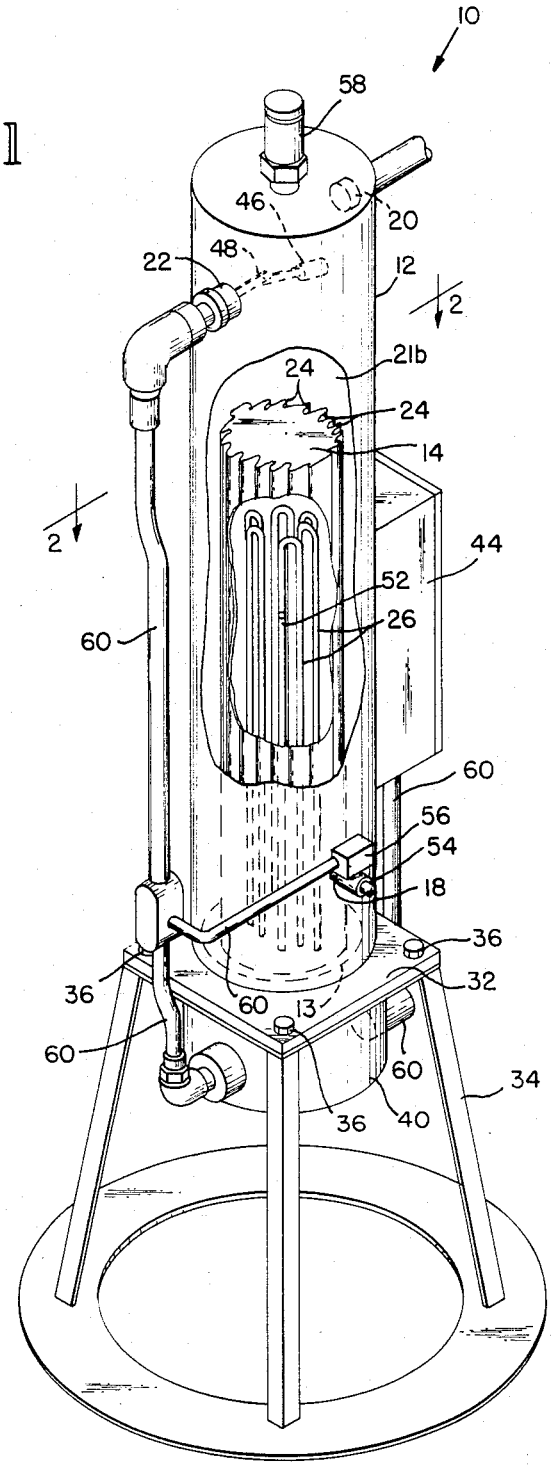
FIG. 1 is a fragmentary isometric view of the vaporizer unit of the present invention.
Figure 3:
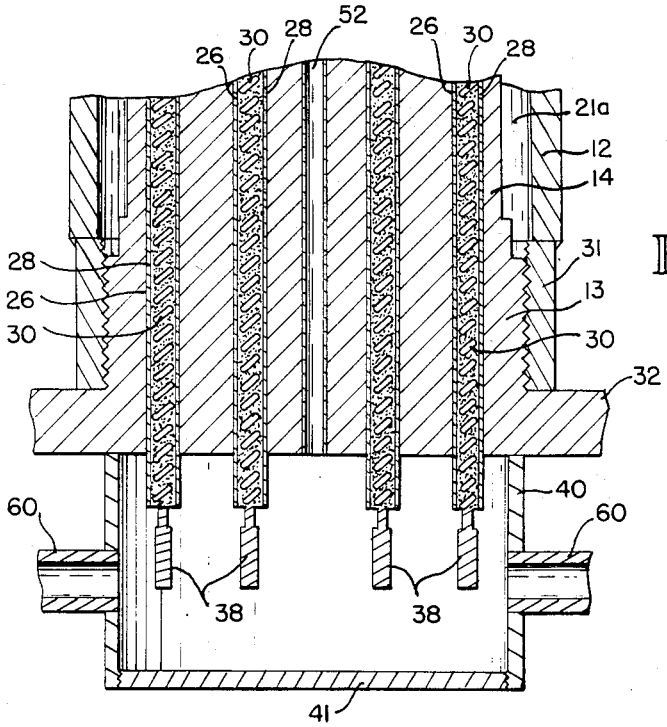
FIG. 3 is a fragmentary sectional view taken substantially along the line 3—3 of FIG. 2.

Referring to FIG. 1, the invention is embodied in a liquefied petroleum gas vaporizer unit 10 having an elongated, cylindrical, vertically oriented pressure vessel 12 of steel, aluminum, cast iron or other suitable metal. The pressure vessel 12 is closed at the top and sealed at the bottom by a base portion 13 of a heat-conductive cast core 14, as best shown in FIG. 3. The pressure vessel 12 may be provided with a suitable heat-containing exterior insulation jacket (not shown). While a liquefied petroleum gas vaporizer is described, the vaporizer may be used for vaporizing ammonia and other liquefied gases.

A liquefied gas inlet 18 is positioned near the bottom of the pressure vessel 12 to receive liquefied gas, and a gas vapor outlet 20 is positioned near the top of the vessel remote from the gas inlet to discharge gas vapor to satisfy a demand load. A high level liquefied gas overflow sensor opening 22 is also positioned near the top of the vessel below the level of the gas vapor outlet 20. As will be described in more detail below, upon the liquefied gas reaching the level of the sensor opening 22, the flow of liquefied gas into the gas inlet 18 is terminated. Except for this upper level limit, the level of liquefied gas in the pressure vessel 12 is uncontrolled and the particular level reached is a product of the demand for gas vapor. This allows a simplified control system for the vaporizer unit 10.

Figure 2:
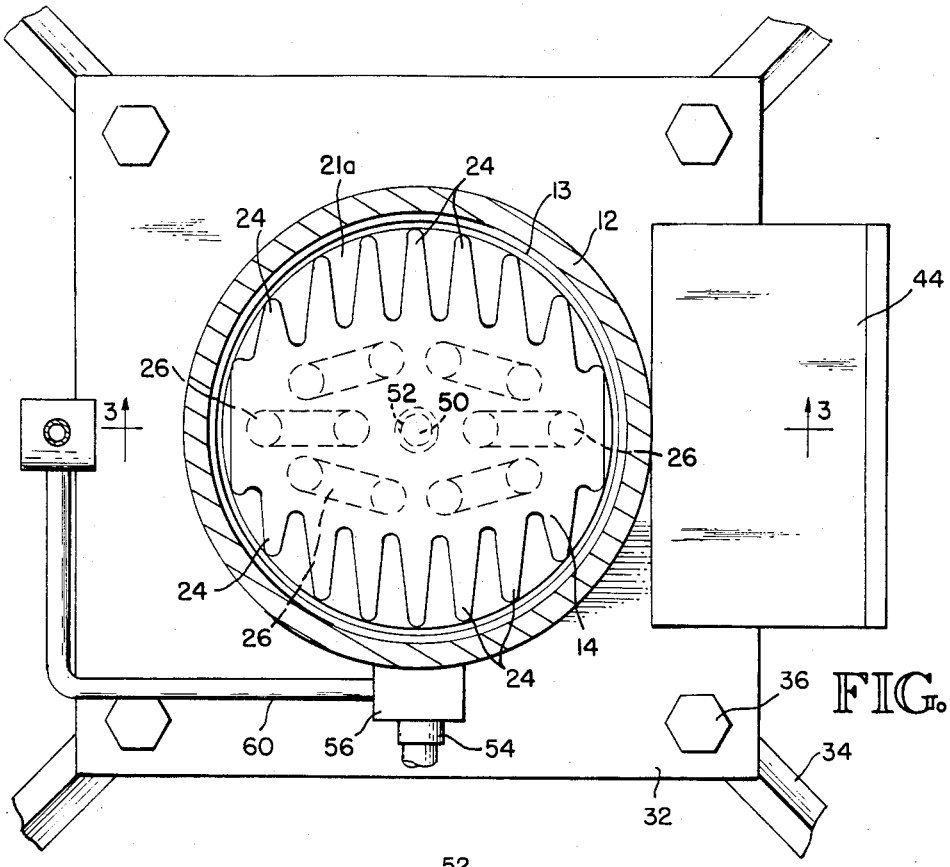
FIG. 2 is an enlarged sectional view taken along substantially along the line 2—2 of FIG. 1.

As shown in FIGS. 1-3, the heater core 14 is positioned to extend within the pressure vessel 12 and preferably is cast from aluminum because of its high heat conductivity. The core 14 may, however, be cast of other suitable heat-conductive metals. The heater core 14 occupies a substantial portion of the interior volume of the pressure vessel 12, with a space **21*a* being provided between the exterior surface of the heater core and the interior wall of the pressure vessel 12. The upper end of the heater core 14 terminates beneath the vapor outlet 20 of the pressure vessel 12 to provide a head space 21*b* of about six to eight inches. The exterior surface of the heater core 14 is provided with fins 24 which extend over substantially the entire length of the portion of the core within the pressure vessel 12 to provide a greater surface area for contact with and heat transfer to the liquefied gas and gas vapor contained in the pressure vessel 12**. As such, an economical and efficient heat transfer surface is provided.

Because of the substantial mass of aluminum used in the core, a flywheel thermal effect occurs in which the heat stored in the core mass is available to quickly meet subsequent sudden surges in demand for vaporized gas if made before the heat dissipates. As such, the heating elements 26 need not fully heat up before any vaporized gas is available and then catch up with the demand. The use of aluminum for the heater core 14 also permits heat from the heating elements 26 to migrate to the liquefied gas quickly for more rapid transfer of the heat to generate gas vapor. Since the heat transfer is relatively quick with aluminum, precision temperature control is possible to minimize temperature overshoots.

A plurality of electric resistance heating elements 26 extending a substantial portion of the length of the heater core 14 are cast in place within the core in close proximity with each other to form an integral core unit. The heating elements 26 have an inverted U-shaped or hairpin configuration and each comprises a tubular sheath 28 containing a coiled resistance wire 30 centered therein with an electrically insulating powder, such as magnesium oxide, packed around the wire. The sheath 28 is fabricated of steel or other heat-conductive material which will withstand the heat of the casting process used to manufacture the heater core 14. The sheath 28 has a thin copper exterior plating. The temperature of the molten aluminum contacting the copper-plated exterior of the heating element sheath 28 during casting of the heater core 14 ensures intimate contact of the aluminum of the resulting casting with the sheath to promote more efficient heat transfer therebetween.

By casting the heater elements 26 in-situ within the heater core 14, the more intimate contact between the core and the sheath 28 provides several advantages over insertion of conventional cartridge heaters into pre-drilled holes in the core, including: (1) preventing hot spots and adding to the life of the elements; (2) allowing application of a higher heat density to the heating elements than can be achieved with cartridge heaters, i.e., 300 watts/in$^2$ vs. 50 watts/in$^2$; (3) allowing placement of a greater number of heating elements of greater heat density in a smaller area of core than is possible with cartridge heaters; and (4) use of the core body as an extension of the heating surface of the heating elements for contact with the liquefied gas and gas vapor. As a result of these advantages, a reliable, more efficient, smaller and more compact, and less expensive design is possible for the vaporizer unit 10 since the heating elements 26 can be shorter in length and packed more closely together, and less aluminum is needed in the cast heater core 14 than would otherwise be required. Moreover, the heater core 14 and the heating elements 26 operate as a single heating unit, with the exterior surface of the core contacting the liquefied gas and gas vapor, rather than the heating elements contacting the liquefied gas and gas vapor directly. The heater core 14 serves as an efficient interface between the heating elements 26 and the liquefied gas and gas vapor.

In one embodiment, the heating elements 26 provide a uniform heat output along their length. In another embodiment of the invention, the heating elements 26 are designed so that approximately the lower $\frac{1}{3}$ of the elements provide a greater heat output than the middle $\frac{1}{3}$ of the elements, and the middle $\frac{1}{3}$ of the elements provide a greater heat output than the top $\frac{1}{3}$ of the elements. This provides a lower liquid gas vaporizing zone, a middle vaporizing zone and an upper vaporizing zone.

The base portion 13 of the heater core 14 is threaded and screws into a correspondingly threaded lower portion 31 of the pressure vessel 12. The threaded design makes the vaporizer unit 10 easy and quick to assemble and disassemble when necessary. The threaded attachment requires less core material than conventional methods of attachment of the core to the pressure vessel, such as using large vessel and base flanges bolted together, while still achieving adequate strength of attachment and leakage prevention. The base portion 13 of the heater core 14 also includes an integrally formed base plate 32 for mounting atop a stand 34 using bolts 36, as illustrated in FIGS. 1 and 2.

The free terminal ends 38 of each of the heating elements 26 extend through the lower end wall of the base portion 13 of the heater core 14 and are exposed for attachment of power wires (see FIG. 3). The heater core 14 has a circumferential sidewall 40 which extends below the lower end wall of the heater core and forms a protective housing around the terminal ends 38 of the heating elements 26. The sidewall 40 has an open lower end and is interiorly sized to receive therein a mating electrical connector (not shown) for the power wires to attach them to the heating elements 26. The open lower end is closed off by a threadably attached cap 41. By integrally forming the protective housing as part of the core, a more compact and less costly design is achieved. Each of the heating elements 26 is connected to suitable electronic control means 42, shown schematically in FIGS. 5A–5C, housed within a weather sealed control housing 44 attached to the exterior of the pressure vessel 12.

The heater core 14, including the heating elements 26 contained therein, may be sized to vaporize from 80 to 160 gal/hr of liquefied gas. Multiple heater cores may be placed within an appropriately sized pressure vessel to vaporize up to as much as 15,000 gal/hr or more. By using a plurality of heater cores 14, a very compact and economical unit may be manufactured. For example, the heater core 14 of the presently preferred embodiment of the invention contains six separate heating elements 26 which are controlled together as a group, but may also be controlled separately to be turned on and off in discrete steps as demand requires. In a 960 gal/hr vaporizer unit, six heater cores 14 and thirty-six independently and separately controllable heating elements 26 are present, thus allowing much greater flexibility in operation of a vaporizer system where the demand for gas vapor may increase or decrease in increments. As many heating elements 26 as are required to meet the demand may be energized while the others are maintained off to minimize energy usage and extend the life of the heating elements.

The head space **21*b* for the gas vapor provided above the upper end of the heater core 14 allows vapor to slow in velocity (because of increased cross-sectional area as it passes upward beyond the upper end of the core) and provides clean separation between the liquid and vapor phases of the gas being vaporized. This is particularly critical when operating the vaporizer unit 10 at or near its flow capacity when the level of the liquefied gas within the pressure vessel 12 is at or close to the upper end of the heater core 14. While shown in the vertical position, the vaporizer unit 10** may be designed to operate in a horizontal position.

In the presently preferred embodiment of the vaporizer unit 10, the pressure vessel 12 is manufactured from six-inch diameter (schedule 40) pipe with a five-inch NPT one-half couple welded to the end of the pipe forming the lower portion 31 of the vessel (See FIG. 3). This provides an inexpensive yet sufficiently strong vessel design.

The heating elements 26 include six hairpin tubular heater elements with one-quarter inch spacing within the aluminum heater core 14. With this arrangement a 300 to 440 watts/in$^2$ energy density can be achieved using heating elements where the normal design is only 50 watts/in$^2$. The energy density for the heater core 14 achieved is very high, with 1.3 to 1.7 pounds of aluminum per kilowatt of power.

The heat transfer surface area of the heater core 14 is very large for the physical size of the vaporizer unit 10 through use of the fins 24, with 0.3 feet per inch of core length. The heat transfer area is approximately 0.25 feet$^2$ per kilowatt, or 0.06 feet$^2$ per gallon per hour of liquefied gas. The basic sizing of heat-to-flow is 4 gallons per hour per kilowatt, or 854 BTU per gallon.

The hairpin heating elements 26 are unheated over their lower four and one-half inches to prevent the interior of the lower sidewall 40 of the heater core 14 provided for connectors or the terminal ends 38 of the heating elements. The upper seven inches of the heating elements 26 are unheated to prevent overheating of the long core. By providing an upper end portion of the heater core 14 which is not heated, a greater heat exchange area is provided for contact with the gas vapor to promote super-heating of the vapor, but without requiring additional heat. Superheating minimizes condensation when the gas vapor leaves the pressure vessel 12 and enters the outside piping. The upper end portion of the heater core 14 extending above the heating elements 26 adds more mass for increasing the thermal flywheel effect and provides increased contact surface area for the gas vapor for heat transfer.

It is important to place the thermocouple 50 from $\frac{1}{3}$ to $\frac{1}{2}$ way up the heater core 14 from the lower end of the core to provide a fast response to demand changes, to prevent overheating of the core and to use only one sensor for control. The space **21*a* between the exterior surface of the heater core 14 and the interior wall of the pressure vessel 12 is about $\frac{1}{4}$ inch, as measured relative to the fins 24 of the core. The space 21*a* is sized to allow adequate flow of liquefied gas and gas vapor and promote heat transfer between the aluminum heater core 14 and the liquefied gas, but is small enough to prevent stagnant areas. The heat transfer coefficient, measured in BTU/(°F.)(feet$^2$)(hour), is 600 as determined from actual test measurements. In effect, the vaporizer unit 10 could be considered a "thin film" vaporizer since the heat transfer coefficient of aluminum is greater than 1500. The small free area between the heater core 14** and the pressure vessel 12 also helps keep liquid volume in the pressure vessel to a minimum of about one gallon at a flow rate of 80 gallons per hour. Approximately 85% of the pressure vessel cross section is occupied by the heater core.

The basic control system for the vaporizer unit 10 includes, in addition to the electronic control means 42, a high liquid level safety switch 43, such as a hermetically sealed reed switch, activated by a float 46 located on an arm 48 projecting through the liquefied gas sensor opening 22, a temperature control thermocouple 50 located in a central bore opening 52 in the approximate center of the heater core 14, an inlet valve 54 at the liquefied gas inlet 18 controlled by a solenoid 56, a relief valve 58, and a backup overtemperature snap disc switch 72. The overtemperature snap disc switch 72 is a redundant overtemperature protection switch mounted to the lower exterior side of the base portion of the heater core 14.

Referring to FIG. 1, liquefied gas enters the pressure vessel 12 through the inlet valve 54 under the control of the solenoid 56. The liquefied gas floods the space 21*a* between the heater core 14 and the interior wall of the pressure vessel 12 and begins to vaporize. Should the unit not be operating correctly and liquefied gas fill the pressure vessel 12 sufficiently to reach the level of the sensor opening 22, the float 46 moves the liquid level switch to activate the solenoid 56 and close the inlet valve 54, shutting off the flow of liquefied gas into the pressure vessel. Wiring connecting the heating elements 26 to an external power supply and wiring interconnecting the control system extend through electrical conduits 60.

The relief valve 58 is mounted in the wall closing the top of the pressure vessel 12 and communicates with the interior head space 21*b* of the pressure vessel. In a conventional manner, the relief valve 58 is responsive to the pressure of the gas vapor therein; and should the pressure exceed the set limit of the valve, it will open to relieve the pressure within the vessel to the atmosphere. While shown with a vertical orientation, the vaporizer unit 10 may be adapted for operation with the pressure vessel 12 extending horizontally.

Figure 5A:
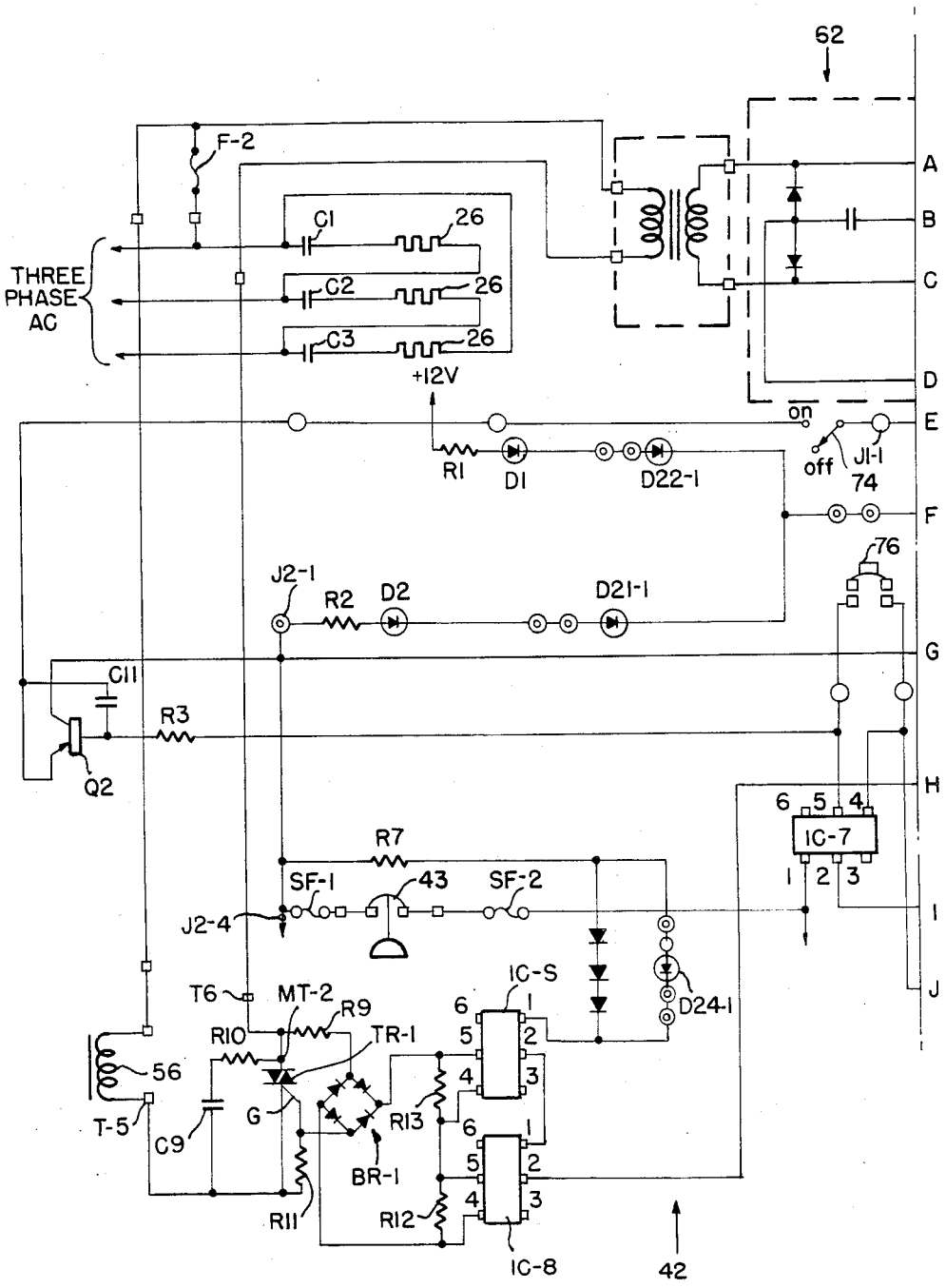
FIGS. 5A, 5B and 5C are, together, a detailed electrical schematic diagram of the safety and proportional controller circuits used with the vaporizer of FIG. 1.
Figure 5B:
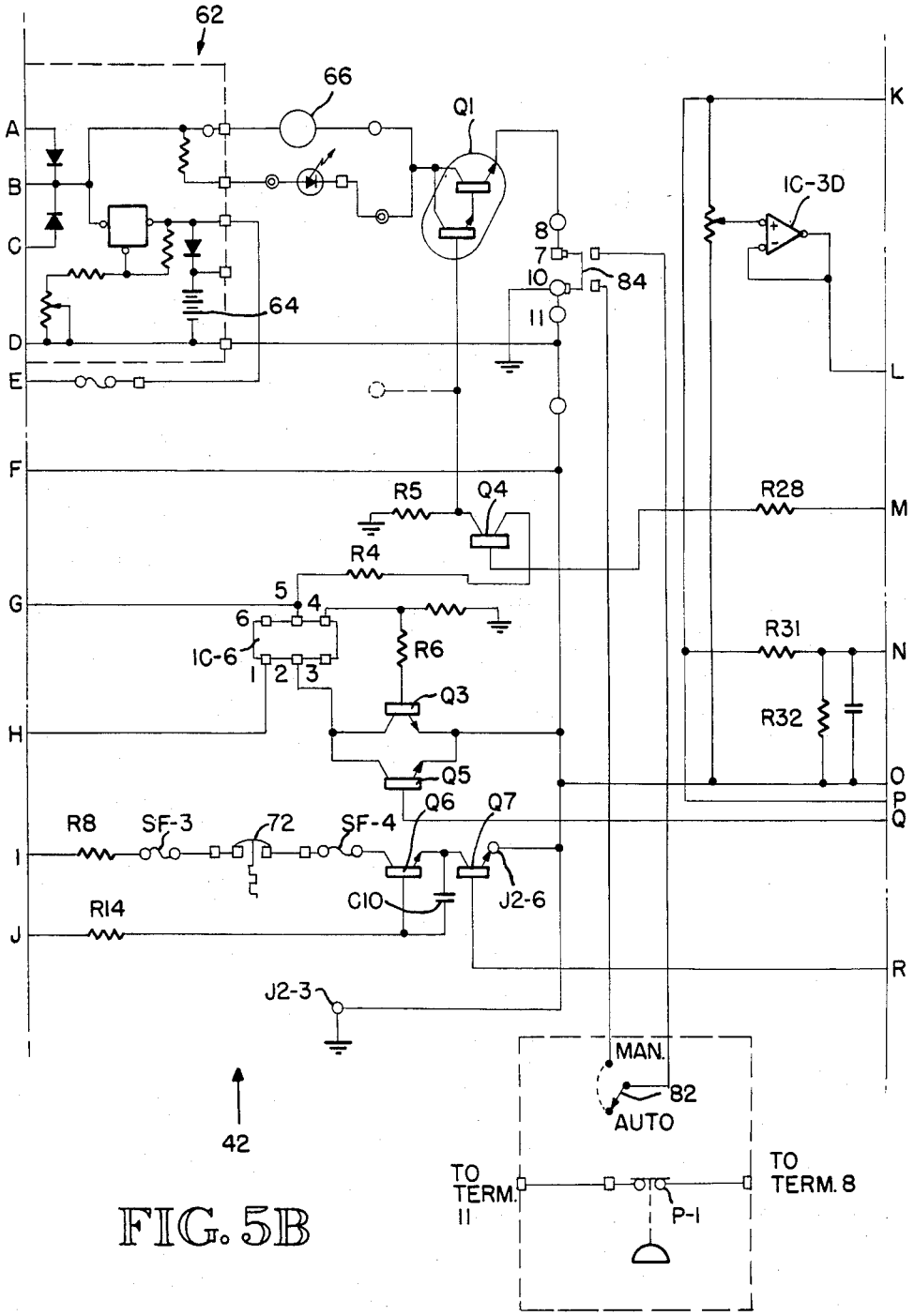
Figure 5C:
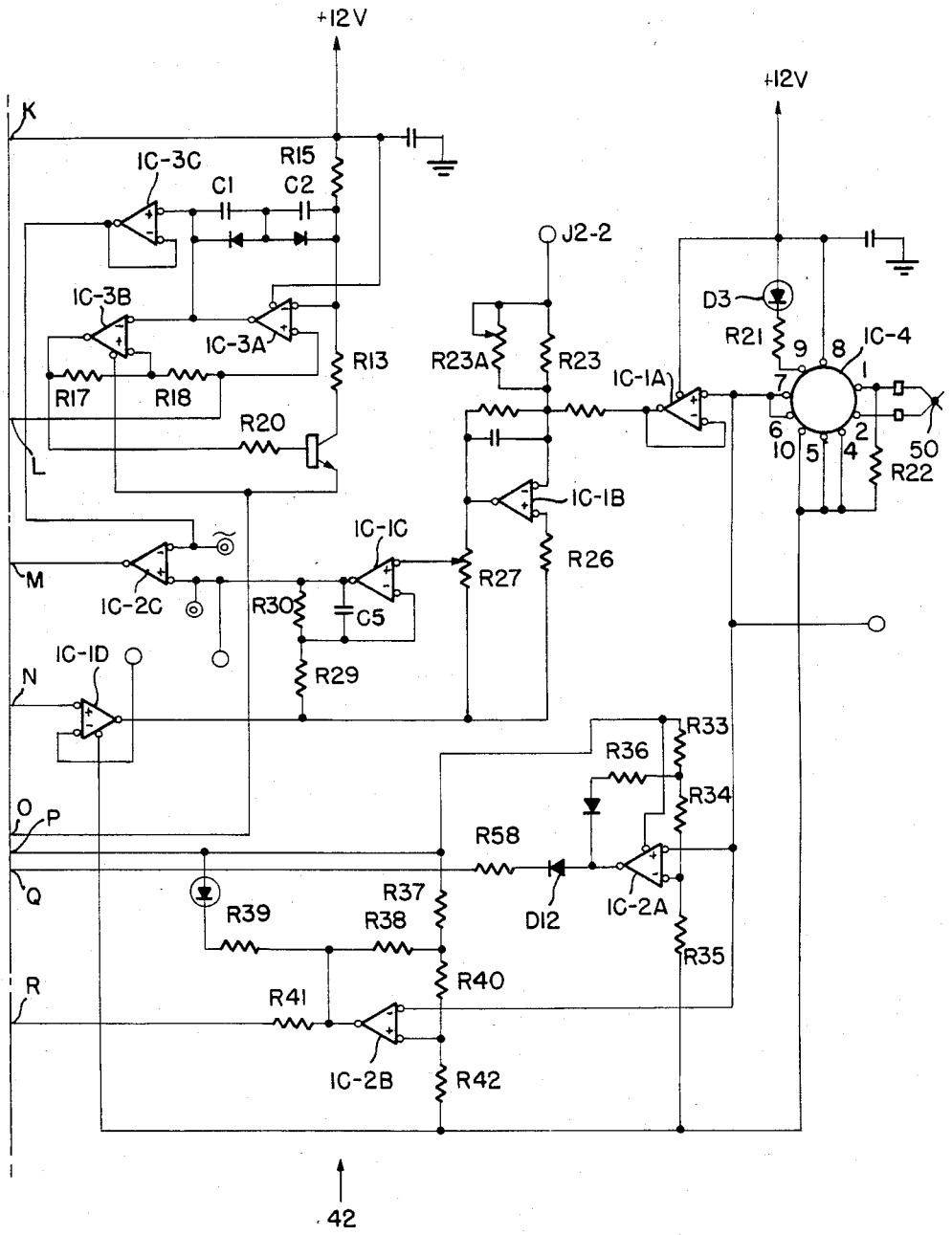
Figure 6:
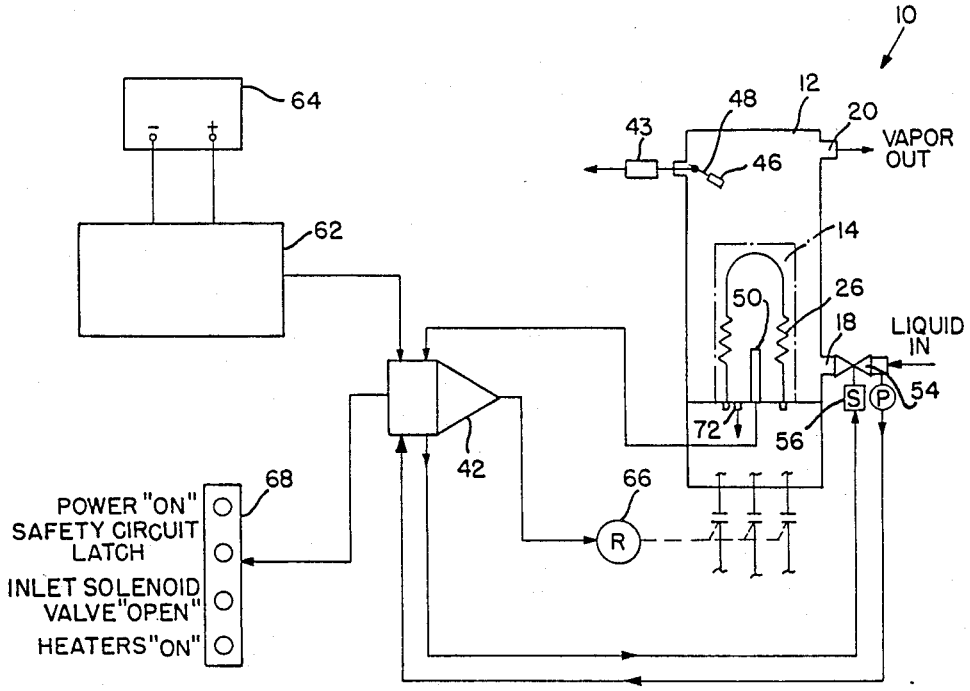
FIG. 6 is a schematic diagram of the vaporizer unit of FIG. 1 showing the various electrical controls and sensors used.

As shown in schematic diagram in FIG. 6, the vaporizer unit 10 is powered by a regulated power supply 62 with an optional battery 64 as a backup. Three-phase alternating current voltage is applied to the heating elements 26 under the control of the electronic control means 42, which includes a power relay 66. As will be described in more detail below and as shown in FIGS. 5A–C, the electronic control means 42 includes a safety circuit and a time-proportional control circuit. The status of the vaporizer unit 10 is displayed by an indicator panel 68 having lights indicating a power "on" condition, a safety circuit latch condition, an open inlet valve condition, and a heating elements "on" condition.

The power relay 66 utilized is a hermetically sealed mercury relay to eliminate sparking, which could ignite an explosive mixture, when the heating elements are turned on and off. For the same reason, the safety and time-proportional control circuits of the electronic control means 42 is operated at low voltage (+12 v.) and at low currents so as to be safe in an explosive environment should one develop. With such a non-incendiary design, applicable industry and governmental safety and fire codes generally can be met without the use of an explosion-proof electrical enclosure for the control housing 44 or special electrical conduits 60 or fittings. When necessary to meet the regulating code, explosion-proof electrical enclosures can be included.

The circuitry for the electronic control means 42 is shown in the detailed schematic diagram of FIGS. 5A–C. The circuitry includes two subsystem circuits. The first is a safety circuit incorporating dual overtemperature protection and protection from high liquid level. The second is a time-proportional control circuit for the electric heating elements 26. Both subsystem circuits are energized by the common power supply 62 which provides a regulated +12 volts and an unregulated +15.5-volt output. The regulated output has built-in protection from overtemperature or short circuits across the output terminals in a conventional manner.

The safety circuit includes transistors Q2, Q6 and Q7, an optic-coupler integrated circuit IC-7, the high liquid level safety switch 43, an overtemperature snap disc switch 72, and a resistor R8. When a power on/off switch 74 is moved to the "on" position, the regulated 12 volts from the power supply 62 is applied to the emitter of the transistor Q2, which serves as a safety circuit switch. Although power has been applied to the emitter of the transistor Q2, at this time no current will flow through Q2 or the other elements of the safety circuit, to be described below, because the flow of base current to the transistor Q2 is blocked by an open phototransistor in integrated circuit IC-7. The integrated circuit IC-7 has a light-emitting diode internally connected between terminals 1 and 2 and optically coupled to an NPN phototransistor internally connected between terminals 4 and 5.

When the current flowing through terminals 1 and 2 reaches a predetermined 8 milliamperes or more, integrated circuit IC-7 terminal 5 is essentially shorted to terminal 4. Current is prevented from flowing from terminal 1 to terminal 2, however, because the transistor Q2 and the transistor Q6 are held open since their mutual base current is zero. Transistor Q7 serves as an electronic overtemperature switch and is held in a conducting state as long as the temperature of the heater core 14, as measured by the thermocouple 50, is below 320° F.

A start switch 76 is connected between terminals 4 and 5 of integrated circuit IC-7, and when depressed, the phototransistor in the integrated circuit IC-7 is shorted by the start switch. This allows current to flow from the +12 volts applied to the emitter of the transistor Q2 through the emitter-to-base junction of the transistor, a resistor R3, the start switch 76, a resistor R14, the base-to-emitter junction of the transistor Q6, and the collector-to-emitter junction of the transistor Q7 (assuming the heater core temperature is below 320° F.), to a common ground. This current causes the transistors Q2 and Q7 to conduct, thus completing the portion of the safety circuit from the collector of the transistor Q2 through connector J2-1 to connector J2-4, a safety fuse SF-1, the float switch 43, a safety fuse SF-2, terminal 1 to terminal 2 of the integrated circuit IC-7, a resistor R8, a safety fuse SF-3, the overtemperature snap disc switch 72, a safety fuse SF-4, the collector-to-emitter junction of the transistor Q6 and the collector-to-emitter junction of the transistor Q7 to a common ground. The current flowing from terminal 1 to terminal 2 of the integrated circuit IC-7 as a result of completing the safety circuit, as described above, causes the phototransistor internally connected between terminals 4 and 5 of the integrated circuit IC-7 to saturate, thus latching the safety circuit in an "on" state, even though the start switch 76 has been released and reopened.

Activation of the safety circuit as described above, activates the time-proportional control circuit. This is accomplished when the safety circuit applies a voltage to the collector of a transistor Q4 from the collector of the transistor Q2. When the base of the transistor Q4 is at a high voltage as a result of a signal received from the time-proportional control circuit, the current flows from the emitter of the transistor Q4 to the base of power transistor Q1 and turns on the transistor Q1. Transistor Q1 energizes the power relay 66 and the power relay applies three-phase alternating current voltage to the heating elements 26 through three relay contacts C1, C2, and C3. When the signal is removed from the base of transistor Q4, power to the heating elements 26 is removed.

Liquefied gas cannot enter the inlet 18 until the inlet valve 54 is opened by the solenoid 56. The coil of the solenoid 56 is shown in FIG. 5A connected between a power supply fuse F-2 and a quick disconnect terminal T-5. The solenoid 56 is energized by a triac TR-1, which is activated when a predetermined current of 8 milliamps or more flows from the collector of the transistor Q2 in the safety circuit through a resistor R7, through diodes D3, D4, and D24-1, terminal 1 to terminal 2 of an optic-coupler integrated circuit IC-5, terminal 1 to terminal 2 of an optic-coupler integrated circuit IC-8, and terminal 1 to terminal 2 of an optic-coupler integrated circuit IC-6, the collector-to-emitter junction of transistors Q3 or Q5 to a common ground. This current flow will be blocked by the transistor Q3 or Q5, which serve as non-conducting switches, until the temperature of the heater core 14 reaches 160° F., as measured by the thermocouple 50.

Upon reaching 160° F., the time-proportional control circuit provides a base current to the transistor Q5 through a resistor R53 and a diode D12 (see FIG. 5C) to cause the transistor Q5 to conduct. When the transistor Q5 is conducting, sufficient current will flow through the terminals 1 and 2 of each of the integrated circuits IC-5, IC-8 and IC-6 to cause the phototransistors across terminals 4 and 5 of the integrated circuits IC-5 and IC-8 to saturate and provide a short circuit across a pair of resistors R12 and R13, and diode bridge BR-1. The short circuit across the diode bridge BR-1 allows unidirectional current to flow into the gate terminal of the triac TR-1, from triac terminal MT-2 through a resistor R9, thus causing the triac to "fire". The "fired" triac provides a short circuit between quick disconnect terminal T-5 to terminal T-6 for a period of one-half cycle of the A.C. line voltage. On succeeding half cycles of A.C. line voltage, the procedure repeats as long as the "safety circuit" is latched. The short circuit between quick disconnect terminals T-5 and T-6 energizes the inlet valve solenoid 56 which opens the inlet valve allowing liquid propane to enter the shell.

Should the heater core temperature reach 320° F. and the overtemperature snap disc switch 72 open or the thermocouple 50 cause the base drive to the transistor Q7 to cease conducting, or should the liquid level rise sufficiently to position the float 46 to open the high liquid level safety switch 43, the current flow through the terminals 1 and 2 of the integrated circuit IC-7 is terminated. This causes the safety circuit to unlatch by opening the connection between the terminals 4 and 5 of the integrated circuit IC-7 placing the transistor Q2 in a non-conducting state. Thus, the collector voltage is removed from the transistor Q4, and hence the power transistor Q1. When power transistor Q1 stops conducting, the power relay 66 is de-energized and alternating current is removed from the heating elements 26 and no further heat is applied to the heater core 14. When the transistor Q2 is placed into a non-conducting state the current flow to the terminals 1 and 2 of the integrated circuits IC-5 and IC-8 is also interrupted, removing the voltage on the gate terminal of the triac TR-1. This deactivates the solenoid 56 and returns the inlet valve 54 to a closed position, preventing liquefied gas from entering the inlet 18. As such, the safety circuit will be put in a standby condition. To return to automatic operation, the malfunction must be corrected and start switch 76 once again depressed to latch on the safety circuit and continue operation.

The time-proportional control circuit includes three quad operational amplifiers IC-1, IC-2, IC-3 and a thermocouple conditioner IC-4 (see FIGS. 5B and C). The thermocouple conditioner IC-4 provides cold-junction compensation for the type-K thermocouple 50 used with the presently preferred embodiment of the invention and a linear analog voltage at terminals 6 and 7 equal to 10 millivolts/degree centigrade. A light-emitting diode D3 provides a warning light in the event of an open thermocouple condition. An open thermocouple condition also causes the analog output of the thermocouple conditioner IC-4 to go to a maximum positive voltage, which shuts down the heating elements 26, thus providing a fail-safe mechanism with respect to thermocouple continuity.

The voltage analogous to temperature from the thermocouple conditioner IC-4 is fed to the remainder of the time-proportional control circuit by the operational amplifier IC-IA, which has a unity gain. The operational amplifier IC-1B is connected as an inverting algebraic summer and the output of the operational amplifier is analogous to the negative of the difference between the temperature measured by the thermocouple 50 and a preselected set point temperature determined by the value of the resistor combination R23 and R23A. In the presently preferred embodiment of the invention, a set point temperature of 180° F. is used. This difference voltage or error signal is attenuated by the proportional band voltage dividers consisting of R27, R46, and R47, and further amplified by the operational amplifier IC-1C.

The operational amplifier IC-1C is connected as a non-inverting amplifier with a voltage gain of twelve. The error signal at the output of the operational amplifier IC-1C is fed to the non-inverting input of the operational amplifier IC-2C, which serves as a comparator. The inverting input of the operational amplifier IC-2C is connected to a low-frequency function generator consisting of the operational amplifiers IC-3A, IC-3B, IC-3C and IC-3D. The voltage output of the function generator has a sawtooth shape when plotted as a function of time. The total transverse of the sawtooth voltage is approximately from a high of 7.5 volts to a low of 3.0 volts. When the sawtooth voltage is less than the error signal at the non-inverting input of the operational amplifier IC-2C, the output of the operational amplifier IC-2C goes high (approximately to 10.5 volts) and this output is applied to the base of the power transistor Q1 through a resistor R28 and the base to emitter of the transistor Q4 to energize the power relay 66 and apply power to the heating elements 26. As previously described with respect to the safety circuit operation, the voltage level on the base of the transistor Q4 turns on and off the power transistor Q1, thus energizing and de-energizing the power relay 66, to selectively apply alternating current to the heating elements 26.

In normal operation, this results in the heating elements 26 being continually turned on and off, with the resulting temperature of the heater core 14, measured by the thermocouple 50, being determined by the ratio of the off-time to on-time of the heating elements 26. If the heater core temperature increases or decreases with respect to the set point temperature of 180° F., the error signal will correspondingly increase or decrease. As such, the signal produced at the output of the operational amplifier IC-2C, which controls the on-off duty cycle of the power to the heating elements 26 during each period of the sawtooth signal, will vary in a time-proportional manner dependent on the magnitude of the error signal. Compensation for and variations in the heater core temperature from the set point temperature occurs within 5 seconds or less and depends upon the size of the variation.

In the presently preferred embodiment of the invention, a very responsive heater core temperature control is achieved with temperature being controllable at about 180° F.±20° F. without the heating elements 26 directly contacting the liquefied gas. With such a design, the liquefied gas and gas vapor is not subjected to undesirable extreme temperature overshoots common in prior art vaporizers. In the preferred embodiment, the thermocouple has less than a two-second response time, and the period of the on-off activity cycle is five seconds. As such, every five seconds, the on-time of the duty cycle is adjusted to compensate for temperature changes measured in the heater core 14 by the thermocouple 50. The period of the duty cycle and the response time of the thermocouple 50 are selected to be sufficiently quick that rapid response to temperature increases in the core temperature is achieved and significant variations in the core temperature from the set point temperature, which could cause overheating of the liquefied gas and gas vapor, are avoided.

With the dynamics of the design configuration of the vaporizer unit 10 described above, the response time of the electronic control means 42 becomes extremely important to the proper functioning of the vaporizer unit. Liquefied gas is completely replaced within the vaporizer unit 10 due to its relatively small interior volume compared to the flow rates at which it operates, every 15–25 seconds. This requires the electronic control means 42 to sense core temperature changes and respond thereto by turning on or off the heating elements 26 within 15 seconds. Furthermore, the aluminum heater core 14 will absorb only a limited amount of heat, approximately 250 BTU per 20° F. temperature rise. Since the heat input is approximately 40 BTU per second, to control within the desired range of ±20° F. deviation from the set point temperature requires the response time of the electronic control means 42 be less than six seconds. The precision of the temperature control is facilitated by the use of a high heat conductive aluminum heater core 14 with the heating elements 26 cast in-situ therein. The vaporizer unit provides a continuously variable heat rate from 0 to 10% of the heating elements capability.

The analog output voltage of the thermocouple conditioner IC-4, which is analogous to the temperature measured by the thermocouple 50, is applied directly to the non-inverting input of the operational amplifier IC-2A and the inverting input of the operation amplifier IC-2B. The operational amplifiers IC-2A and IC-2B serve as temperature switches. In the presently preferred embodiment, the operational amplifier IC-2A is biased to activate at 160° F., and the operational amplifier IC-2B is biased to activate at 320° F. The output of the operational amplifier IC-2A controls actuation of the solenoid 56, which opens and closes the inlet valve 54 by applying the output of the operational amplifier to the base of the transistor Q5, as previously described with respect to the safety circuit operation. Until the heater core 14 reaches 160° F., the transistors Q5 and Q3 are held switched off and in an open state. When the heater core 14 reaches 160° F., the transistor Q5 conducts and the solenoid 56 opens the inlet valve 54 to allow liquefied gas to enter the inlet 18. Additional on-off activity by operational amplifier IC-2A and transistor Q5 will have no effect as the inlet valve system is held in the open state by the latching action of the transistor Q3. The transistor Q3 is held in a high conduction saturated condition by base current from the safety circuit via integrated circuit IC-6 terminal 5 to terminal 4, and transistor Q3 base resistor R6.

The output of the operational amplifier IC-2B is connected to the base of the transistor Q7, which serves as the overtemperature switch, and eliminates the base current to the transistor Q7 upon the heater core reaching 320° F., as measured by the thermocouple 50. As previously described with respect to the safety circuit operation, this interrupts the current flow and unlatches the safety circuit so that it reverts to a standby condition without power being applied to the heating elements 26. To return to automatic operation, the temperature must have decreased below 320° F. and the operator must depress the start switch 76 once again.

Figure 4:
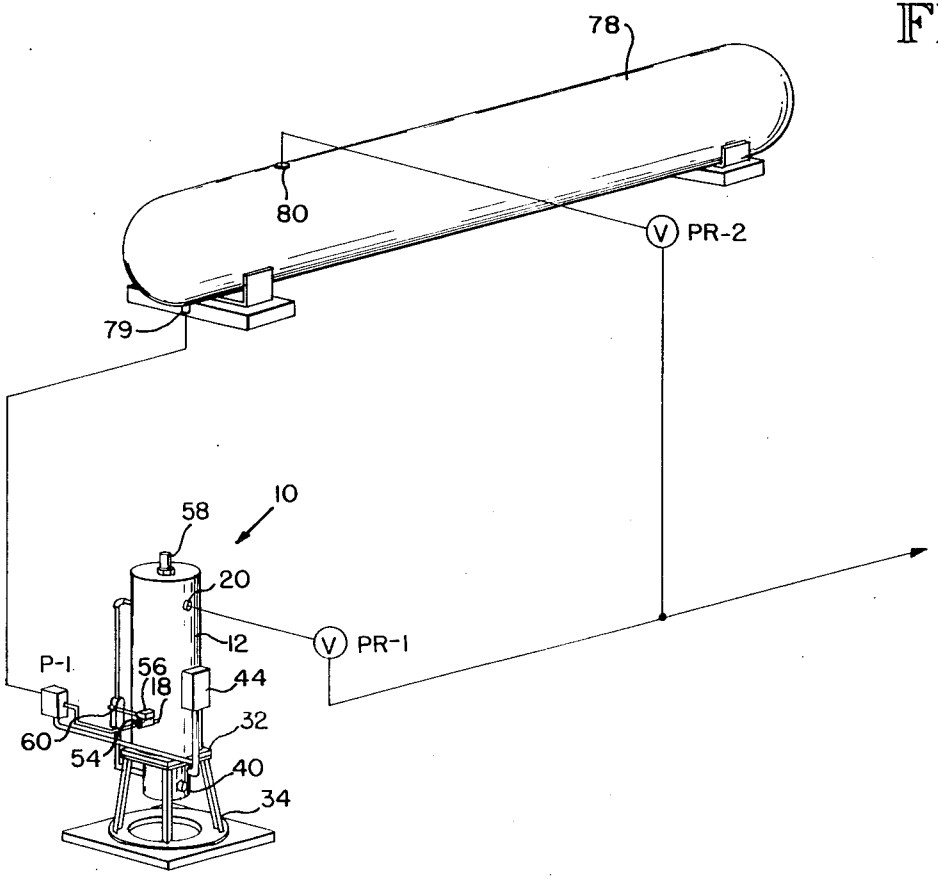
FIG. 4 shows the vaporizer unit of the present invention connected for operation in a standby mode with a liquefied petroleum gas tank.

In FIG. 4, the vaporizer unit 10 of the present invention is shown connected to a liquefied petroleum gas storage tank 78 for operation in an automatic standby mode. The inlet valve 54 is connected by an input line to a liquefied gas withdrawal fitting 79 of the storage tank 78. Connected in the liquefied gas withdrawal line extending from the inlet valve 54 is a conventional two-set point pressure switch P-1 (shown schematically). Connected between the gas vapor outlet 20 of the vaporizer unit 10, and the gas vapor demand load is a high-pressure regulator PR-1. Connected between a gas vapor withdrawal fitting 80 at the top of the storage tank 78 and the gas vapor line leading from the regulator PR-1 to the load is second high-pressure regulator PR-2. In an automatic mode of operation, power is not supplied to the heating elements 26 of the vaporizer unit 10 when the gas vapor in the storage tank 78 has high enough pressure to supply sufficient quantities of gas vapor to the load. This would normally occur on days during which the ambient outside temperature generates a sufficient vapor head above the liquefied gas within the storage tank that it can be drawn off to meet the load demand. In this situation, the vaporizer unit 10 is kept on standby and energy is saved by not having to power the heating elements 26. When the pressure of the gas vapor in the storage tank 78 falls below a predetermined low pressure, the vaporizer unit 10 is automatically turned on to meet the demand. When the gas vapor pressure in the storage tank increases beyond a predetermined high pressure, the vaporizer unit 10 is turned off and the demand is met by drawing off the gas vapor in the storage tank.

By way of example, the pressure regulator PR-1, connected to the gas vapor outlet 20 of the vaporizer unit 10, may be set at 12 psi and the pressure regulator PR-2, connected to the gas vapor fitting 80 of the storage tank 78, may be set at 8 psi. As such, when the vaporizer unit 10 is operating, gas vapor will flow to the load only through the vaporizer unit 10. The two-set point pressure switch P-1 may be set to turn on the vaporizer unit 10 at a lower set point of 25 psi and to turn off the vaporizer at an upper set point of 50 psi. In operation, the vaporizer unit 10 will be in a standby mode until the pressure in the storage tank 78 is reduced below 25 psi and operates to meet demand until the pressure in the storage tank reaches 50 psi.

Referring to FIGS. 5 and 6, the electronic control means 42, includes an automatic operating circuit which permits the operation of the vaporizer unit 10 in the automatic standby mode. A manually operable switch 82 is positioned as shown in FIG. 5B during normal operation of the vaporizer unit. If it is desired to use the vaporizer unit in the standby mode in conjunction with the storage tank 78, the switch is moved to the opposite position and a removable jumper 84 is removed. Consequently, instead of the emitter of the power transistor Q1 being connected directly to common ground, the emitter is connected to the two-set point pressure switch P-1, which is connected through the switch 82 to common ground. When in the standby mode of operation, the safety and time-proportional control circuits continue to operate as previously described, except that any signal from the transistor Q4 to the base of the power transistor Q1 will not result in energizing of the power relay 66 unless the pressure switch P-1 has been closed as a result of a low pressure condition in the storage tank 78.

Closing of the pressure switch P-1 occurs when the pressure in the storage tank 78 with which the vaporizer unit 10 is operating in a standby mode falls below the lower set point pressure and it is necessary for the vaporizer unit to produce gas vapor. Closure of the pressure switch P-1 enables the power transistor Q1 and allows the power relay 66 to apply lower to the heating elements 26 in the fashion previously described. When the pressure switch P-1 opens in response to the pressure in the storage tank 78 increasing above the upper set point pressure, the power transistor Q1 is disabled and energizing of the power relay is inhibited and, hence, application of power to the heating element 26 is prevented. The upper set point pressure being a tank pressure whereas it is no longer necessary for the vaporizer unit 10 to produce gas vapor since there is sufficient gas vapor pressure in the storage tank to supply the anticipated demand. In such manner, the natural vaporization of the storage tank 78 may be utilized with the vaporizer unit 10 serving as an automatic backup to supply gas vapor should the vaporization of the tank be insufficient to meet the demand. It is estimated that savings from between 20 to 80% of the energy needed to operate the vaporizer unit can be realized, depending upon the size of storage tank used, the weather conditions present, and the load demand.

In the presently preferred embodiment, conventional components are employed throughout, and the following components, identified by part number and manufacturer, may be used. Again it will be understood that the invention is not limited to use of the specific components set forth herein:

| Symbol | Part Type | Number | P/N | Manufacturer* |
|---|---|---|---|---|
| Q1 | Transistor | TIP-10 | NPN Darlington | MOT, GE |
| Q2 | Transistor | 2N3906 | PNP | TI, MOT, GE, RCA, NAT |
| Q3 | Transistor | 2N3904 | NPN | MOT, GE, TI, RCA NAT |
| Q4 | Transistor | 2N3904 | NPN | MOT, GE, TI, RCA, NAT |
| Q5 | Transistor | 2N3904 | NPN | MOT, GE, TI, RCA, NAT |
| Q6 | Transistor | 2N3904 | NPN | MOT, GE, TI, RCA, NAT |
| Q7 | Transistor | 2N3904 | NPN | MOT, GE, TI, RCA, NAT |
| Q8 | Transistor | 2N3904 | NPN | MOT, GE, TI, RCA, NAT |
| Q9,Q10 | Transistor | 2N3904 | NPN | MOT, GE, TI, RCA, NAT |
| Q11 | Transistor | DK41D11 | | GE |
| IC-1 | Operational Amplifier Quad | | LM324N | NAT |
| IC-2 | Operational Amplifier Quad | | LM324N | NAT |
| IC-3 | Operational Amplifier Quad | | LM324N | NAT |
| IC-4 | Thermocouple Amplifier/ Conditioner | | AD597 | ANALOG DEVICES |
| IC-5 | Opto-Coupler | | MOC8204 | MOT |
| IC-6 | Opto-Coupler | | 4N33 | MOT |
| IC-7 | Opto-Coupler | | MOC8204 | MOT |
| IC-8 | Opto-Coupler | | MOC8204 | MOT |
| TR-1 | Triac | | 2N6073 | MOT |
| BR-1 | Bridge Rectifier | | MDA108A | MOT |

-continued

| Symbol | Part Type | Number | P/N | Manufacturer* |
|---|---|---|---|---|
| IC-100 | Voltage Regulator | | LM31T | NAT |

*MOT—MOTOROLA INC.
GE—GENERAL ELECTRIC
RCA—RADIO CORP OF AMERICA
NAT—NATIONAL SEMICONDUCTOR
TI—TEXAS INSTRUMENTS

The vaporizer unit 10 of the present invention provides a compact, efficient means for controlled vaporization of liquefied petroleum gas or other liquefied gases to deliver, as needed, the correct gas vapor load, regardless of the external ambient temperature. The precision temperature control provided prevents excessive overheating of the petroleum liquefied gas and allows operation at a relatively low operating temperature, with minimal temperature overshooting of the the heater core 14. This is in contrast to direct contact of liquefied petroleum gas with a heat source with severe temperature overshooting, which causes cracking of the gas vapor and oil separation, resulting in polymerization, tar residues and undesirable components.

Another advantage of the vaporizer unit is that it can go from no load to full load in a matter of seconds and thus can quickly respond to load changes, making it easy to control in relation to the demand for gas vapor.

It will be appreciated that, although specific embodiments of the invention have been disclosed herein for purposes of illustration, various modifications may be made without departing from the spirit and scope of the invention. Accordingly, the invention is not limited except as by the appended claims.

We claim:

1. A compact liquefied gas vaporizer for controlled vaporization of liquefied gas, comprising:

a hollow pressure vessel having a liquefied gas inlet and a gas vapor outlet;

an elongated, one-piece, heat-conductive core mounted within the pressure vessel, the core having multiple electric resistance heating elements cast in-situ within the core to provide an interface between the heating elements and the liquefied gas and to provide intimate contact of the core with the exterior of the heating elements;

at least one temperature-sensing passageway in the core holding a temperature-sensing means; and control means connected to the electric resistance heating elements and the temperature-sensing means for regulating the supply of power to the electric resistance heating elements.

2. The vaporizer of claim 1 wherein the pressure vessel has a threaded open end to receive a correspondingly threaded portion of the core for easy assembly and disassembly of the core and the pressure vessel.

3. The vaporizer of claim 2 wherein the base portion of the core includes an outwardly projecting and open ended protective housing attached to an end wall of the core and formed as an integral part thereof, the heating elements extending through the end wall for connection to electrical power connectors, the protective housing being sized to receive the power connectors therein.

4. The vaporizer of claim 1 wherein the temperature-sensing passageway is a central bore in the core extending longitudinally between the heating elements for at least a portion of the length on the core and not communicating with the interior volume of the pressure vessel.

5. The vaporizer of claim 14 wherein the temperaturesensing means is a thermocouple positioned within said central bore.

6. The vaporizer of claim 1 wherein the temperature-sensing means is a quick-response temperature sensor and the control means includes a time-proportional controller for applying electrical power to the heating elements with a periodic on/off duty cycle determined by the deviation of the core temperature, as measured by the temperature sensor, from the predetermined set temperature, the period of the duty cycle being sufficiently short to rapidly respond to temperature inceases in the core temperature from the predetermined value which could cause overheating of the liquefied gas and gas vapor, the inceasing of the core temperature above the set temperature proportionally reducing the on-time of the duty cycle and the decreasing of the core temperature below the set temperature proportionally increasing the on-time of the duty cycle, whereby the controller provides quick response to temperature variations in the core temperature to avoid temperature overshooting and thus avoid undesirable overheating of the liquefied gas and gas vapor.

7. The vaporizer of claim 6 wherein the control means further includes a liquefied gas flow inhibit means for inhibiting the flow of liquefied gas into the liquefied gas inlet until the core temperature reaches a predetermined minimum operating temperature, whereby cold liquefied gas is prevented from reaching the core until the heating elements have had sufficient time to raise the core temperature to the minimum operating temperature.

8. The vaporizer of claim 6 wherein the control means further includes a high-temperature inhibit means for inhibiting the application of electrical power to the heating elements if the core temperature reaches a predetermined maximum operating temperature, whereby the overheating of the liquefied gas and gas vapor, and damage to the heating elements and pressure vessel are prevented.

9. The vaporizer of claim 1 wherein an upper end of the core terminates below the gas vapor outlet to provide a head space above the core for expansion of the rising gas vapor within the pressure vessel in response to heating of the liquefied gas by the heating elements.

10. The vaporizer of claim 1, further including a liquefied gas-sensing means communicating with the interior of the pressure vessel near an upper end thereof, below the gas vapor outlet, for sensing the level of liquefied gas in the pressure vessel and in response thereto controlling a valve requlating the flow of liquefied gas into the liquefied gas inlet, the valve being controlled to shut off the flow of liquefied gas into the pressure vessel before the liquefied gas enters the gas vapor outlet.

11. The vaporizer of claim 1 wherein the core is cast of aluminum.

12. A compact liquefied gas vaporizer for controlled vaporization of liquefied gas, comprising:

a vertically oriented, cylindrical, hollow pressure vessel having a liquefied gas inlet near an open lower end and a gas vapor outlet near a closed upper end remote from the liquefied gas inlet;

an elongated, one-piece, heat-conductive core mounted within the pressure vessel and occupying a substantial portion of the interior volume of the pressure vessel, the core being positioned to close the lower end of the pressure vessel, the core having multiple electric resistance heating elements extending longitudinally therein and cast in-situ within the core to provide intimate contact of the core with the exterior of the heating elements;

at least one temperature-sensing passageway in the core holding a temperature-sensing means; and control means connected to the electric resistance heating elements and the temperature-sensing means for regulating the supply of power to the electric resistance heating elements.

13. The vaporizer of claim 12 wherein the lower end of the pressure vessel is threaded to receive a correspondingly threaded base portion of the core for easy assembly and disassembly of the core and the pressure vessel.

14. The vaporizer of claim 13 wherein the base portion of the core includes a support flange.

15. The vaporizer of claim 13 wherein the base portion of the core includes a downwardly projecting, outwardly opening protective housing attached to a lower end wall of the core and formed as an integral part thereof, the heating elements extending through the lower end wall for connection to electrical power connectors, the protective housing being sized to receive the power connectors therein.

16. The vaporizer of claim 12 wherein the temperature-sensing means is a quick-response temperature sensor and the control means includes a time-proportional controller for applying electrical power to the heating elements with a periodic on/off duty cycle determined by the deviation of the core temperature, as measured by the temperature sensor, from a predetermined set temperature, the period of the duty cycle being sufficiently short to rapidly respond to temperature increases in the core temperature and avoid significant variations in the core temperature from the predetermined value which could cause overheating of the liquefied gas and gas vapor, the increasing of the core temperature above the set temperature proportionally reducing the on-time of the duty cycle and the deceasing of the core temperature below the set temperature proportionally increasing the on-time of the duty cycle, whereby the controller provides quick response to temperature variations in the core temperature to avoid temperature overshooting and thus avoid undesirable overheating of the liquefied gas and gas vapor.

17. The vaporizer of claim 16 wherein the control means further includes a liquefied gas flow inhibit means for inhibiting the flow of liquefied gas into the liquefied gas inlet until the core temperature reaches a predetermined minimum operating temperature, whereby cold liquefied gas is prevented from reaching the core until the heating elements have had sufficient time to raise the core temperature to the minimum operating temperature.

18. The vaporizer of claim 16 wherein the control means further includes a high-temperature inhibit means for inhibiting the application of electrical power to the heating elements if the core temperature reaches a predetermined maximum operating temperature, whereby the overheating of the liquefied gas and gas vapor, and damage to the heating elements and pressure vessel are prevented.

19. The vaporizer of claim 12 wherein the upper end of the core terminates below the gas vapor outlet to provide a head space above the core for expansion of the rising gas vapor within the pressure vessel in response to heating of the liquefied gas by the heating elements.

20. The vaporizer of claim 12 wherein the temperature-sensing passageway is a central bore in the core extending longitudinally between the heating elements for at least a portion of the length on the core and not communicating with the interior volume of the pressure vessel.

21. The vaporizer of claim 12 wherein the heat-conductive core extends sufficiently above the upper end of the heating elements to provide increased core surface area for superheating the gas vapor, whereby condensation is reduced upon the gas vapor leaving the pressure vessel and immediately contacting outside piping.

22. The vaporizer of claim 12, further including a liquefied gas-sensing means communicating with the interior of the pressure vessel near its upper end, below the gas vapor outlet, for sensing the level of liquefied gas in the pressure vessel and in response thereto controlling a valve regulating the flow of liquefied gas into the liquefied gas inlet, the valve being controlled to shut off the flow of liquefied gas into the pressure vessel before the liquefied gas enters the gas vapor outlet.

23. The vaporizer of claim 12 wherein the core is cast of aluminum

24. The vaporizer of claim 12 wherein the core has a finned exterior surface to provide greater surface area for heat transfer to the liquefied gas.

25. The vaporizer of claim 12, further including a pressure relief valve communicating with the interior of the pressure vessel near its upper end and responsive to the pressure of the gas vapor therein.

26. A compact liquefied gas vaporizer for controlled vaporization of liquefied gas, comprising:

a hollow presure vessel having a liquefied gas inlet and a gas vapor outlet, and having a threaded open end;

an elongated, one-piece, heat-conductive core mounted within the pressure vessel, the core having multiple electric resistance heating elements cast in-situ within the core to provide an interface between the heating elements and the liquefied gas and to provide intimate contact of the core with the exterior of the heating elements, the core having a threded portion corresponding to the threaded open end of the pressure vessel for removable attachment thereto;

at least one temperature-sensing passageway in a central portion of the core extending longitudinally between the heating elements and sized for holding a temperature-sensing means, the temperature-sensing means being a quick-response temperature sensor; and control means connected to the electric resistance heating elements and the temperature sensor for regulating the supply of power to the electric resistance heating elements, the control means including a time-proportional controller for applying electrical power to the heating elements with a periodic on/off duty cycle determined by the deviation of the core temperature, as measured by the temperature sensor, from the predetermined set temperature, the period of the duty cycle being sufficiently short to rapidly respond to temperature increases in the core temperature from the predetermined value which could cause overheating of the liquefied gas and gas vapor, the increasing of the core temperature above the set temperature proportionally reducing the on-time of the duty cycle and the decreasing of the core temperature below the set temperature proportionally increasing the on-time of the duty cycle.

27. The vaporizer of claim 26 wherein the control means further includes a liquefied gas flow inhibit means for inhibiting the flow of liquefied gas into the liquefied gas inlet until the core temperature reaches a predetermined minimum operating temperature, whereby cold liquefied gas is prevented from reaching the core until the heating elements have had sufficient time to raise the core temperature to the minimum operating temperature.

28. The vaporizer of claim 27 wherein the control means further includes a high-temperature inhibit means for inhibiting the application of electrical power to the heating elements if the core temperature reaches a predetermined maximum operating temperature, whereby the overheating of the liquefied gas and gas vapor, and damage to the heating elements and pressure vessel are prevented.

29. The vaporizer of claim 28, furthe including a liquefied gas-sensing means communicating with the interior of the pressure vessel near an upper end thereof, below the gas vapor outlet, for sensing the level of liquefied gas in the pressure vessel and in response thereto controlling a valve regulating the flow of liquefied gas into the liquefied gas inlet, the valve being controlled to shut off the flow of liquefied gas into the pressure vessel before the liquified gas enters the gas vapor outlet.

30. A liquefied gas vaporizing system, comprising a liquefied gas storage tank having a liquefied gas withdrawal line and a gas vapor withdrawal line;

a hollow pressure vessel having a liquefied gas inlet connected to the liquefied gas withdrawal line of the storage tank and a gas vapor outlet connected to a gas vapor demand line, the gas vapor demand line being coupled to the gas vapor withdrawal line of the storage tank;

an elongated, one-piece, heat-conductive core mounted within the pressure vessel, the core having multiple electric resistance heating elements cast in-situ within the core to provide an interface between the heating elements and the liquefied gas and to provide intimate contact of the core with the exterior of the heating elements;

at least one temperature-sensing passageway in the core holding a temperature-sensing means;

control means connected to the electric resistance heating elements and the temperature-sensing means for regulating the supply of power to the electric resistance heating elements;

a pressure switch connected in the liquefied gas withdrawal line, the pressure switch activating the control means for operating of the electric resistance heating elements upon storage tank pressure falling below a predetermined lower level, and deactivating the control means for inhibiting operation of the electric resistance heating elements upon the storage tank pressure rising above a predetermined upper level, the upper level pressure being selected at a tank pressure achievable by natural vaporization and sufficient to provide gas vapor directly from the storage tank of the demand line;

a first pressure regulator positioned in the gas vapor withdrawal line of the storage tank; and a second pressure regulator positioned in the gas vapor demand line, between the pressure vessel and the juncture with the gas vapor withdrawal line of the storage tank, the second pressure regulator having a regulated pressure above the regulated pressure of the first pressure regulator, whereby the second pressure regulator insures that all flow will pass through the pressure vessel when the storage tank pressure is insufficient to satisfy gas vapor demand from the natural vaporization occurring in the storage tank.

* * * * *

UNITED STATES PATENT AND TRADEMARK OFFICE

CERTIFICATE OF CORRECTION

PATENT NO. : 4,645,904

DATED : February 24, 1987

INVENTOR(S) : Dennis P. Moraski

It is certified that error appears in the above—identified patent and that said Letters Patent is hereby corrected as shown below:

In the Claims:

Claim 5, change dependency from claim 14 to claim 4.

Claim 6, line 12, the word "inceasing" should be changed to "increasing".

Claim 29, line 1, the word "furthe" should be changed to read "further".

Signed and Sealed this

Twenty-ninth Day of December, 1987

*Attest:*

DONALD J. QUIGG

*Attesting Officer*

*Commissioner of Patents and Trademarks*